United States Patent [19]

Bastasch

[11] 4,037,388

[45] July 26, 1977

[54] BAG SUPPLY SYSTEM FOR BAGGING MACHINE

[75] Inventor: Frank J. Bastasch, Palos Verdes Estates, Calif.

[73] Assignee: United Bakery Equipment Company, Inc., Kansas City, Kans.

[21] Appl. No.: 691,234

[22] Filed: June 1, 1976

[51] Int. Cl.[2] ..... B65B 57/04; B65B 43/32

[52] U.S. Cl. ..... 53/64; 53/189

[58] Field of Search ..... 53/64, 67, 69, 70, 71, 53/73, 74, 189

[56] References Cited

U.S. PATENT DOCUMENTS

| | | | |
|---|---|---|---|
| 3,440,801 | 4/1969 | Prince et al. | 53/189 |
| 3,556,316 | 1/1971 | Marasso | 53/189 X |
| 3,715,857 | 2/1973 | Fronczak | 53/189 X |

*Primary Examiner*—Travis S. McGehee

*Attorney, Agent, or Firm*—Lowe, Kokjer, Kircher, Wharton & Bowman

[57] ABSTRACT

A bagging machine in which a series of spaced pusher arms serve to successively move articles linearly from a source toward and into individual bags located in a stack of bags at a bagging station. The stack of bags at the station is carried on a bag table supported on a bag supply conveyor system which extends to one side of the machine. The conveyor includes additional bag tables for carrying a plurality of stacks of bags in standby condition. The conveyor system is automatically controlled to replace an empty table with a loaded table in response to removal of the last bag on the table at the bagging station. Means are also provided for interrupting the movement of the pusher arms during transition of a loaded table into the space vacated by the empty table.

4 Claims, 7 Drawing Figures

BAG SUPPLY SYSTEM FOR BAGGING MACHINE

BACKGROUND AND SUMMARY OF THE INVENTION

The invention relates to improvements in machines used for automatically packing articles such as bakery goods and the like in bags. It refers more particularly to the provision of an arrangement for providing a substantially constant supply of bags at the bagging station for the machine.

In my U.S. Pat. No. 3,492,780, issued Feb. 3, 1970, a bagging machine of the general character for which the present invention is intended is disclosed. The machine of the patent is equipped with a bagging station at which is located a stack of bags placed atop one another on a bag support plate. As the product is moved through the bagging station, it is directed into the topmost bag on the stack and the bag is then stripped from the stack to ready another bag for reception of the next arriving product. In due course the stack of bags is emptied, which necessitates the installation of a new stack so that operations may continue.

In my aforesaid prior patent I provided an arrangement in which it was possible to locate a standby stack of bags adjacent the bagging station in position to be moved into the bagging station upon depletion of the bags in the operative stack. However, the arrangement was manual, required access to both sides of the machine for loading the standby stack and had no arrangement for determining when the operative stack was exhausted other than by visual monitoring.

One of the principal objects of the present invention is to provide an arrangement wherein several bag stacks can be located in position to be successively fed into the bagging station as the stack which precedes it is exhausted. A feature of the invention in this respect is that all of the standby stacks are located on one side only of the machine thus making it possible to place the bagging machine closely adjacent a wall or one another and permitting an attendant to confine his operations to one side only of the machine.

Another object of the invention is to provide a bag supply system in which the feeding of successive stacks of bags into the bagging station is automatic. I provide as part of my invention a bag supply control system which is operative to cause immediate replacement of an exhausted stack without requiring the assistance of a worker.

Still another object of the invention is to provide a bag supply system which is capable of holding a large supply of bags in standby condition and which makes it possible to make long product runs without restoring the bag supply.

A further object of the invention is to provide a bag supply system in which means are included for automatically interrupting the supply of product to the bagging station while a standby stack is in transition from the standby to operative position. This feature insures that no product will be fed toward the bagging station unless a bag is in correct position to receive it.

Other and further objects of the invention, together with the features of novelty appurtenant thereto, will appear in the course of the following description.

DETAILED DESCRIPTION OF THE INVENTION

In the accompanying drawings, which form a part of the specification and in which like reference numerals indicate like parts in the various views.

Figure 1:
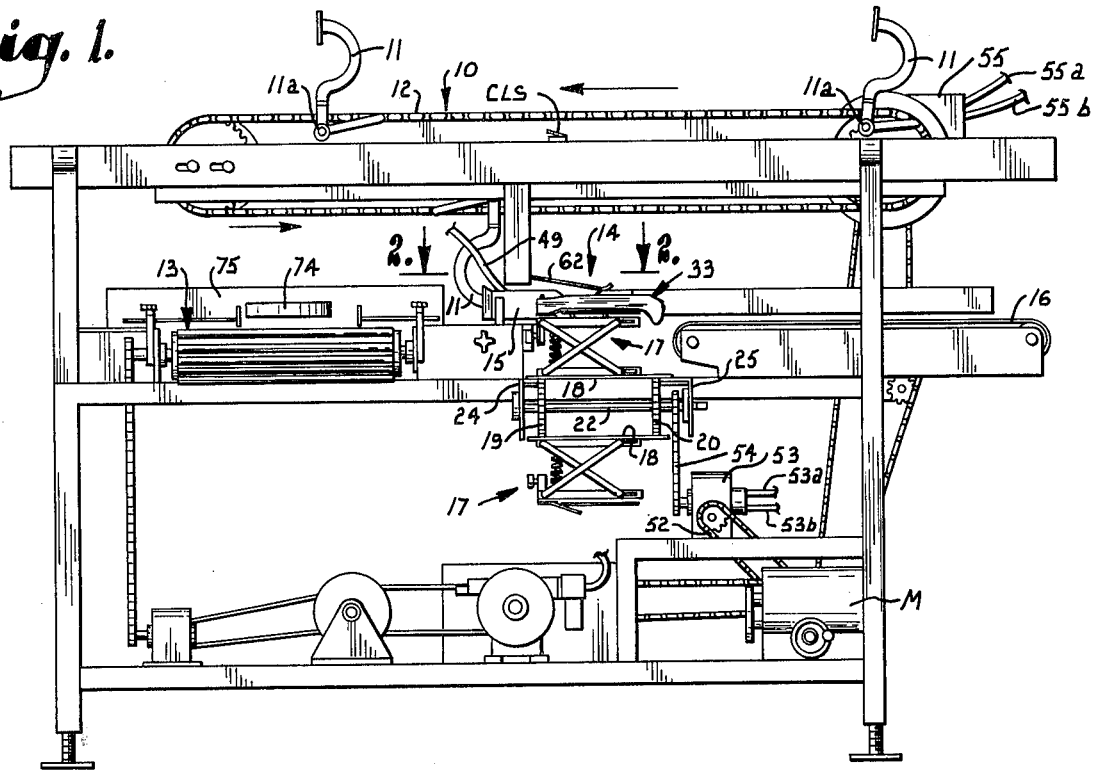
FIG. 1 is a side elevational view of a bagging machine incorporating the preferred embodiment of an automatic bag table system according to the invention.

For a detailed description of a bagging machine for which the automatic bag table system disclosed herein is an improvement, reference is made to my U.S. Pat. No. 3,492,780, issued Feb. 3, 1970 and entitled "Automatic Bag Packaging Machine," which patent is specifically incorporated herein by reference. As shown in FIG. 1 such a bagging machine includes an overhead transfer conveyor 10 having a plurality of spaced pusher arms 11 mounted on an endless chain 12. The transfer conveyor 10 moves the product to be packaged from the left-hand end of the machine, where the product is fed to a position to be contacted by the pusher arms from an in-feed conveyor 13, to a bagging station generally designated by the numeral 14. At the bagging station 14 the arms 11 of the transfer conveyor 10, with the assistance of reciprocating tuckers 15, deliver the product into a bag and then on to a discharge conveyor 16. The discharge conveyor operates at a higher speed than the transfer conveyor 10 in order that the bagged product moves forward relative to the pusher arm 11, thus withdrawing the bag from contact with the arm. The discharge conveyor 16 transports the bagged product to subsequent handling equipment such as tying or sealing machines (not shown).

In general, the automatic bag table system comprises a plurality of bag tables 17 which are mounted in spaced relationship along an endless conveyor assembly projecting laterally to one side of the machine adjacent the bagging station 14. The bag tables will be described in greater detail at a later point herein; at present it should be noted that each table is carried on a flat plate 18 which spans between two parallel roller chains 19, 20 which form part of the bag table conveyor assembly. The roller chains are trained around sprockets at each end of the conveyor assembly. The sprockets at the inner end, i.e., the end of the conveyor adjacent the bagging station 14 are mounted on an axle 21 (see FIG. 3) while those at the outer end are mounted on the axle 22 (see end FIG. 1). The axles are supported in bearings carried by spaced side frame members 24, 25 located on opposite sides of the conveyor assembly and secured to and extending from the frame of the bagging machine.

The side frame members 24, 25 provide support for runners **24*a*, 25*a* (see FIGS. 3 and 4**) which underlie and provide vertical support for the top flights of the chains of the conveyor thus to maintain the bag tables in a stable horizontal path as they are moved by the conveyor assembly.

In the preferred embodiment the bag table system comprises 8 bag tables. At any given time of operation, there are four tables on top and four tables underneath the conveyor with one of the tables located at the bagging station 14. The tables are arranged symmetrically on the conveyor so that, as shown in FIG. 3, the bag table which has been depleted of bags has been moved around the axle 21 to a position directly below the succeeding table, which is in operative position in the machine.

The bag tables are identical in construction and consequently only one will be described in detail, it being understood that the same description applies to the remaining tables. Each table includes a pair of spaced parallel base members 24 which are secured to the top of the plate 18. The members 24 provide support for a pair of cross rods 25 and 26 which extend between them. The cross rod 25 is fixed in position relative to the members 24; the rod 26 extends through and is guided within a slot 24*a* in each base member for limited longitudinal movement relative to the members 24.

Rods 25 and 26 are connected with the respective lower ends of two pairs of pivotally interconnected scissor links 27 and 28, one pair being on each side of the table. The upper ends of the links 27, 28 are connected with rods 29 and 30. Rod 29 connects links 28 with a pair of upper table support members 31 for pivotal movement relative thereto about a relatively fixed pivot axis. Rod 30, like the lower rod 26, extends through horizontally elongated openings 31*a* in the upper table members. The scissor links 27 and 28 are connected by the pivot connection 32. The result is that the upper table members 31 are capable of vertical movement relative to the plate 18. The scissor linkage serves to maintain the members 31 in a horizontal orientation during movement either up or down.

Figure 3:
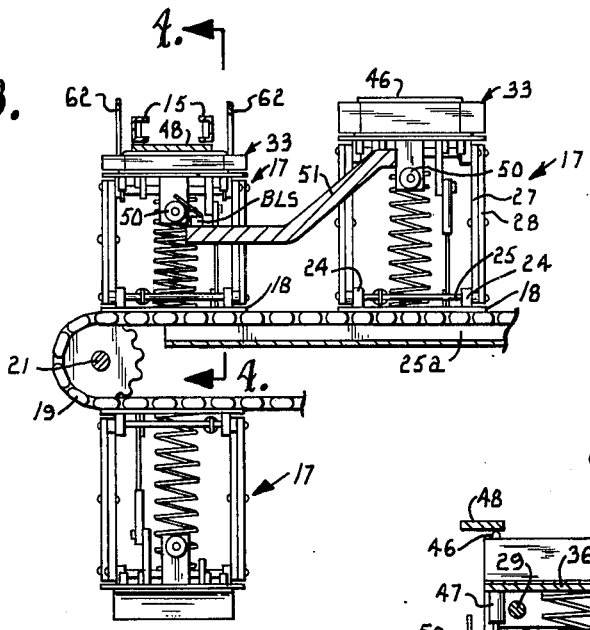
FIG. 3 is a fragmentary sectional view taken along line 3—3 of FIG. 2 in the direction of the arrows.
Figure 4:
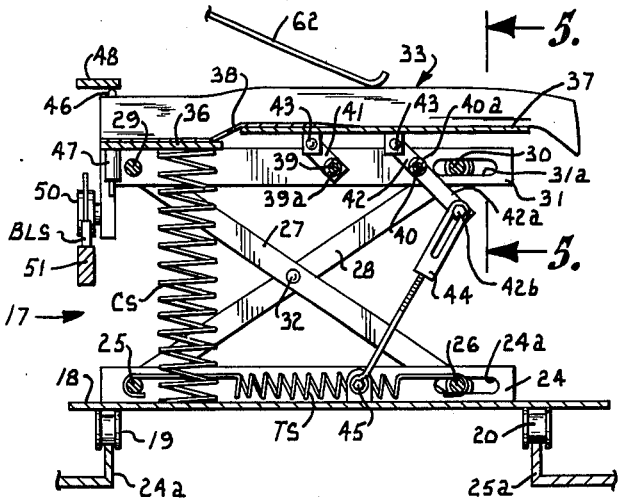
FIG. 4 is a fragmentary sectional view, on an enlarged scale, taken along line 4—4 of FIG. 3 in the direction of the arrows.
Figure 6:
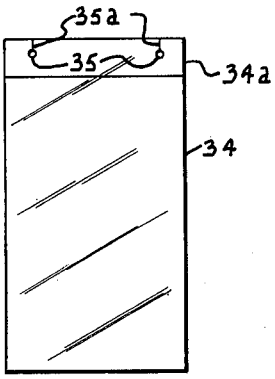
FIG. 6 is a plan view of a typical bag.

Referring still to FIGS. 3 and 4 in particular, reference numeral 33 identifies a stack of bags, which bags are like those disclosed in my aforesaid U.S. Pat. No. 3,492,780. Each bag 34 (see FIG. 6) is open at one end. The open end of the bag is provided with an extension flap 34*a,* which in turn is provided with a pair of transversely spaced perforations 35 which connect with slits 35*a* running to the forward edge of the bag. The bag is essentially a two ply bag in that portion beyond the flap 34, with the flap being only one ply.

The top of the bag table is made in three parts. There is a forward plate like portion 36 which is rigidly affixed to and extends between the top members 31. There is an articulated relatively movable rearward table portion 37 which supports the main part of the bag. And there is a very flexible intermediate filler member 38, one end of which is riveted or otherwise secured to the front portion 36, the other end of which overlies and is free to move with respect to the rear table portion 37. The purpose of filler member 38 is to provide a bridge over the gap that develops between the two table portions 36 and 37 during the course of operation. As shown in FIG. 4, the filler member is sufficiently flexible that when bags are stacked on the table, it conforms to the configuration of the top table portions 36 and 37.

Figure 5:
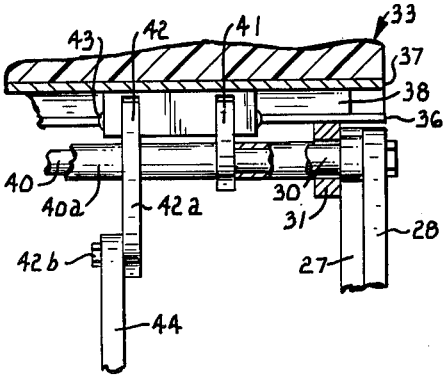
FIG. 5 is a fragmentary sectional view, still further enlarged, taken along line 5—5 of FIG. 4 in the direction of the arrows.

The relatively movable top table portion 37 is supported on a linkage which is best seen in FIGS. 4 and 5. Two parallel spaced rods 39 and 40 are secured to and extend between the members 31. Each rod has slidably fitted over it a sleeve 39*a* or 40*a* which extends substantially the full length of the rod between the members 31, thereby to be stabilized on the rod while still permitting rotation of the sleeve. The sleeves carry a pair of radial links 41 and 42. The outer ends of links 41 and 42 are pivotally pinned, as at 43, to lugs secured to the underside of the movable table portion 37. The link 42 includes an extension 42*a* which is pivoted at 42*b* to a link 44 which is adjustable in length. The lower end of link 44 is anchored as at 45 to a lug on the plate 18 at the bottom of the table assembly.

The bags are secured to the table through the medium of a U-shaped wire or wicket 46. The bags are stacked on one another with the flap portions adjacent the forward end of the table portion end 36. The legs of wire 46 are threaded through the openings 35 of the bag flaps and down through openings in alignment sleeves 47 depending from the underside of the bag support plate 36. The fit in sleeves 47 is loose or free fit so that the wicket or wire can be received more deeply in the sleeves as the supply of bags is depleted.

It will be noted that the upper portion of the bag table comprising the members 31 and table portions 36 and 37 are constantly biased toward the upper extended position for the scissor mechanism by means of two springs. There is a horizontal tension spring TS having end hooks which engage over the lower cross rods 25 and 26, and a coiled compression spring CS which extends between the plate 18 and the forward portion 36 of the bag table. These two springs co-act to maintain upward pressure on the bag table and to bias it toward a vertically extended position.

Referring to FIG. 3, when a bag table is in the operative position it is located on the centerline of the machine in symmetrical relationship with the tuckers 15. The positioning of the bags and bag table is controlled by a stop member 48 which is secured to and extends from the frame of the machine, as shown in my prior patent earlier referred to. With a full stack of bags on the table, the top table members will be in a retracted position with the springs constantly urging the table upwardly against the stop member. As bags are depleted from the stack, the upper portion of the table will rise, the forward portion 36 rising at one rate while the rear portion 37 rises at a faster rate due to the articulating linkage by which it is connected to the members 31. This serves to provide a compensation for the dual thickness of bag material which exists toward the rear portion of the table as against only a single thickness portion as represented by the flaps 34. The table will continue to rise until the last bag has been stripped from it.

In my prior referenced patent, I disclose one form of obtaining opening of the bags prior to delivery of the product. While I have not shown that specific equipment in the present application it can be used. Alternatively, the region of the tucker is fitted with one or more air conduits 49 (see FIG. 2) providing jets of pressurized air directed at the juncture of the flap with the bag opening. The jets serve to blow the plies apart so that the tuckers and product can enter.

As will be evident, in moving the bag tables from the standby position, which is the position generally shown in FIG. 1, it is necessary to depress the scissors linkage against the action of the springs in order to bring the bags into their proper operative position at the bagging station. To this end, each table is provided at its forward end with a cam roller 50. The cam roller operates to engage the underside of a cam track 51 secured to the frame of the machine. This cam track has a downwardly inclined portion followed by a horizontal portion which terminates just short of the centerline of the bagging station. When the roller clears the end of the cam track, the springs cause the top portion of the table to rise until the bag wicket 46 is engaged against the stop 48.

The feeding of the bag table to the bagging station is, in the preferred embodiment, automatic, although it also can be accomplished by manual means as will later be described.

In the automatic arrangement the bag conveyor is powered from the central power source of the bagging machine through a power take off chain 52 and a combined speed reducer and pneumatically controlled clutch 53 which is drivingly connected by the take-off chain to the main drive motor M for the bagger. The clutch is under the control of a relay subsequently to be described and has the pneumatic lines **53*a* and 53*b*. As will subsequently be explained, the output of the drive assembly 50 is periodically applied by chain drive 54 to axle 21** of the bag conveyor system.

The drive train to the upper transfer conveyor is also equipped with a pneumatically controlled clutch 55 which is operable to interrupt and brake the upper transfer conveyor in response to certain controlling conditions. The pneumatic lines **55*a* and 55*b*** connect therewith. The clutch mechanisms are of types readily known to those skilled in the bagging machine art and since the specific details are not a part of my invention, no further description will be given.

Figure 7:
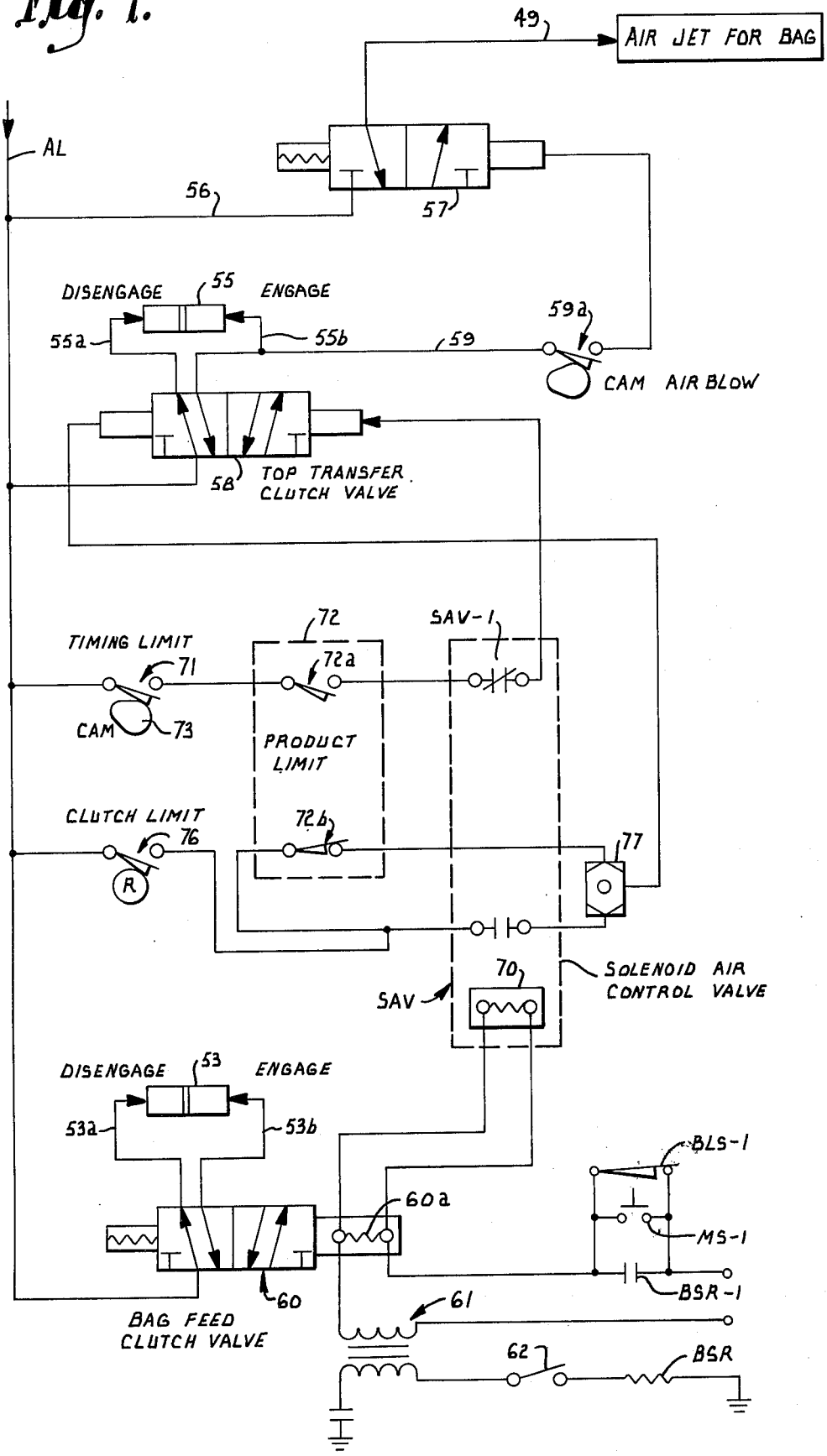
FIG. 7 is a schematic diagram showing the electric and pneumatic control system as it relates to the automatic bag table system.

The principal components of the automatic control system are depicted in FIG. 7. The main air line from the machine compressor is indicated at AL. Air under pressure is supplied from the main air line by line 56 to one side of the bag blower valve 57. Valve 57 controls the supply of air jets from the conduit 49 at the bagging station which serves to open and inflate the bags as heretofore described.

The air line AL also supplies air to the engage — disengage sides of the top transfer conveyor clutch 55 through a top transfer clutch valve 58 and the disengage line **55*a* and engage line 55*b*. The engage line also is connected through line 59 and a cam controlled valve 59*a* to supply pressure to the actuator for the bag blower valve 57.**

Referring to the lower portion of the schematic (FIG. 7), the bag conveyor clutch valve is shown at 60. This valve is similar to the top transfer valve 58, but has only one actuator, being spring loaded toward the illustrated condition which corresponds to the disengaged condition for its associated clutch.

The bag conveyor clutch valve is operated by a solenoid **60*a* which is actuated under control of a bag sensing means operating in the electrical circuitry shown in the lower right-hand portion of FIG. 7. The solenoid is in a 110 volt AC circuit which is controlled by three switches in parallel; a normally open relay contact BSR-1, a normally open manual switch MS-1, and a bag feed limit switch BLS-1. The switch BLS-1 is biased normally closed, but, when a bag table arrives in proper position in the bagging station, it is opened by the bag table. The physical location of the switch is shown in FIG. 3. It senses the presence of the cam roller 50** at the center of the bag station but closes when the bag table and roller move out of the bagging station in response to movement of the bag table conveyor and remains closed until the next bag table moves into operating position.

Figure 2:
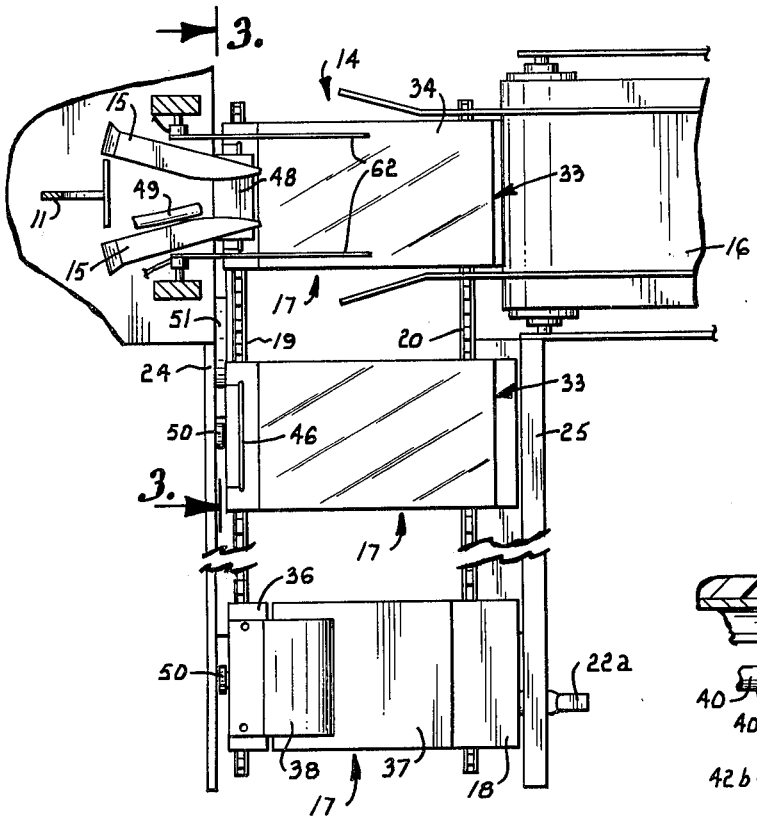
FIG. 2 is a fragmentary sectional view, on an enlarged scale, taken generally along line 2—2 of FIG. 1 in the direction of the arrows.

The electrical circuitry includes a low voltage DC circuit provided by transformer 61, the switch contacts 62 and the coil of the bag sensing relay BSR. The contacts 62 are part of a bag sensing arrangement, the principal components of which are shown in FIGS. 1 and 2. These components comprise two elongate parallel electrically conductive fingers which are pivoted at one end above the tuckers 15 to the structural member 63 of the main bagging machine frame. The fingers 62 extends forwardly so that their ends rest upon the top surface of the stack of bags. Since the bags are of a dielectric material, for example, polyethylene, there will be no electrical contact between the fingers and the table (which is made of metal and electrically grounded) until the final bag is removed from the table. When this occurs the DC circuit is closed and the bag sensing relay BSR is energized.

The immediate consequence of closing of the bag sensing switch contacts 62 is the closing of contact BSR-1 in the electric circuit to the clutch bag conveyor clutch valve 60, which results in a shift of position of that valve to supply pressure to the engage side of the bag table conveyor clutch. This engages the drive to the conveyor, and, consequently, the empty bag table will start moving out of its position. Eventually the fingers 62 will disengage from the table and that contact, i.e., the contact provided by contacts 62, will be broken. However, by this time the table has moved away from engagement with the bag limit switch BLS-1, and it has therefore returned to a closed condition which holds the circuit to the clutch valve closed until the next table arrives and moves into position thereby disengaging the bag limit switch.

The completion of the electrical circuit through the bag sensing relay BSR resulting from contact between the fingers and table also energized a second solenoid 70 which performs as part of a solenoid actuated valve SAV very much like the bag feed clutch valve, but which is connected in the pneumatic circuitry to the top transfer clutch valve 58. The purpose of the second valve is to insure that no matter what the situation is in the bagging machine with respect to presence or absence of product, the top transfer conveyor will be disengaged and halted from further movement while the bag conveyor is in motion. The details of the circuit as it relates to the top transfer clutch valve will now be described.

There are two pneumatic circuits which are associated with the disengaged side of the top transfer clutch valve.

First is a circuit which includes normally blocked ports of a valve 71, the normally blocked ports **72*a* of a product limit valve 72 and the normally connected ports SAV-1 of the solenoid control valve SAV. The position of the solenoid control valve is such that so long as the valve is de-energized, a pneumatic line is open to the engage side of the transfer clutch valve, and consequently, whenever the product is present the timing cam 73, which controls valve 71, will produce the desired intermittent operation of the top transfer conveyor to match the movement of the pushers with the arrival of product at the product limit switch. The product air limit valve 72 has an actuator arm 74 (see FIG. 1) which is carried by a buffer wall 75 against which product is delivered by the in-feed conveyor 13. When the product strikes the arm 74 the valve ports 72*a* in the product limit valve 72** are connected thus permitting engagement of the clutch at such times as the timing cam calls for it to be engaged.

However, in the event that the valve 71 is open and the product limit valve is also open to flow, energization of the solenoid air control valve SAV will result in blocking of the ports SAV-1 in the control valve, thereby preventing engagement of the top transfer clutch until such time as the control valve is de-energized The timing cam 73 is driven from the power supply for the bagger and is so set that it properly relates the operations of the transfer conveyor to the feed of the product.

Additional control circuitry involves the valve 76 which is operated off the clutch limit switch CLS illustrated in FIG. 1. This air switch is in position such that its actuator can be contacted by a roller 11*a* on each pusher arm at a preselected position during operation. The purpose of the clutch limit control is that if no product is present, i.e., if the circuit through the second ports 72*b* of the product limit valve is open to flow as illustrated, then the limit switch will cause the top transfer conveyor to stop with a pusher arm located just short of the in-feed conveyor. It will be noted that the circuitry is such that even if the product limit valve is a condition resulting from presence of product, i.e., ports 72*a* blocked and ports 72*b* open, nonetheless energization of the air control valve SAV causes flow to occur through to the shuttle valve 77 and thus to the disengage side of the top transfer clutch valve. In other words, even though no product may be present when the clutch limit switch valve 75 is open to flow, the air pressure will be applied through the now open ports SAV-2 of the solenoid control air valve to supply pressure to the disengage side of the top transfer clutch valve thus disengaging and braking the top transfer in the proper "home" position.

It will be evident from the circuitry shown in FIG. 7 that the movement of the bag table conveyor can be accomplished through manipulation of the manual switch MS-1 with essentially the same consequences. Moreover, the manual control of the movement of the conveyor can also be effected by placing a crank handle on the extension 22*a* of axle 22 (see FIG. 2) and cranking the conveyor to move the bag tables into the appropriate position.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is comtemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. In an article bagging machine having a pusher for moving articles linearly toward and through a bagging station where the articles are individually bagged, the combination therewith of a bag supply conveyor extending transversely with respect to the bagging station and supporting a plurality of bag tables for movement of the tables transversely into and out of the bagging station, each bag table adapted to carry a stack of bags, power means operable to drive said conveyor at intermittent intervals thus to move the bag tables successively into and out of the bagging station, and control means operable to cause engagement of said power means when the last bag has been removed from the table in said bagging station and to disengage said power means when the next bag table has arrived at the bagging station, said bag tables having top bag support surfaces which are movable vertically relative to the conveyor and are resiliently biased toward an upwardly extended position, means for depressing said surfaces during movement of said tables from the position next to the bagging station into the bagging station and releasing same at the station so that the table surfaces with the bags thereon may rise, and stop means engaging the topmost bag to limit the vertical movement to less than the extended position for said surfaces so that said surfaces continue to rise as bags are progressively removed from the stack.

2. The combination as in claim 1, said bag supply conveyor comprising an endless conveyor with the bag tables located at spaced intervals along upper and lower runs thereof, the upper run of said bag supply conveyor terminating adjacent the bagging station.

3. The combination as in claim 1, said power means including a power source and a normally disengaged clutch connecting said source with said conveyor, and said control means including first sensing means operable to sense the removal of the last bag on the table at the bagging station and to cause engagement of said clutch, and further sensing means sensing the arrival of the next bag table at the bagging station and operating to cause disengagement of the clutch.

4. The combination as in claim 1, said bag supporting surfaces including a forward surface and a rearward surface, said forward surface adapted to support a single ply bag portion and the rearward surface a two ply portion, and means causing said rearward surface to be elevated higher than said forward surface during upward movement thereof.

* * * * *